US007801313B2

(12) United States Patent
Sako et al.

(10) Patent No.: US 7,801,313 B2
(45) Date of Patent: Sep. 21, 2010

(54) METHOD AND APPARATUS FOR REPRODUCING AUDIO SIGNAL

(75) Inventors: Yoichiro Sako, Tokyo (JP); Susumu Yabe, Tokyo (JP); Toshiro Terauchi, Tokyo (JP); Kosei Yamashita, Kanagawa (JP); Masayoshi Miura, Chiba (JP)

(73) Assignee: Sony Corporation, Tokyo (JP)

( * ) Notice: Subject to any disclaimer, the term of this patent is extended or adjusted under 35 U.S.C. 154(b) by 1172 days.

(21) Appl. No.: 11/248,960

(22) Filed: Oct. 11, 2005

(65) Prior Publication Data

US 2006/0078132 A1 Apr. 13, 2006

(30) Foreign Application Priority Data

Oct. 12, 2004 (JP) ..... 2004-297093

(51) Int. Cl.
*H04R 5/00* (2006.01)
*H04R 5/02* (2006.01)

(52) U.S. Cl. ..... 381/17; 381/300; 381/303; 381/306; 381/310

(58) Field of Classification Search ..... 381/310, 381/27, 17, 300, 303, 304, 332, 336, 306, 381/89

See application file for complete search history.

(56) References Cited

U.S. PATENT DOCUMENTS 6,584,202 B1 6/2003 Montag et al.
6,694,033 B1 2/2004 Rimell et al.
2004/0151325 A1* 8/2004 Hooley et al. ..... 381/18
2005/0175197 A1* 8/2005 Melchior et al. ..... 381/310

FOREIGN PATENT DOCUMENTS

| | | | |
|---|---|---|---|
| DE | 10254404 | * | 6/2004 |
| JP | 04-132499 | | 5/1992 |
| JP | 2001-517005 A | | 10/2001 |
| JP | 2002-505058 A | | 2/2002 |
| JP | 2006-507727 A | | 3/2006 |
| WO | WO 2004/047485 A1 | | 6/2004 |
| WO | WO 2004047485 | * | 6/2004 |

OTHER PUBLICATIONS

Geluk, R.J, "A Monitor System based on Wave-Synthesis", Preprints of Papers Presented at the AES Convention, Feb. 26, 1994, p. 1-16, vol. 96 No. 3789.

Boone, Marinus M et al., "Spatial Sound-Field Reproduction by Wave-Field Synthesis", Journal of Audio Engineering Society, Dec. 1, 1995, p. 1003-1012, vol. 43, No. 12, Audio Engineering Society, New York, NY, US.

(Continued)

*Primary Examiner*—Vivian Chin
*Assistant Examiner*—Paul Kim
(74) *Attorney, Agent, or Firm*—Wolf, Greenfield & Sacks, P.C.

(57) ABSTRACT

An audio signal is supplied to a loudspeaker array to perform wavefront synthesis. A virtual sound source is produced at an infinite distance using wavefront synthesis.

12 Claims, 13 Drawing Sheets

OTHER PUBLICATIONS

Boone, Marinus M, "Acoustic rendering with wave field synthesis", ACM Siggraph and Eurographics Campfire: Accoustic Rendering for Virtual Enviornments, May 29, 2001, p. 1-9, Snowbird, Utah, US.
Bauer, Benjamin B.: "Broadening the area of stereophonic perception" Journal of the Audio Engineering Society, vol. 8, No. 2, Apr. 1, 1960, pp. 91-94.
Kates, James M.: "Optimum loudspeaker directional patterns" Journal of the Audio Engineering Society, Audio Engernieering Society, New York, NY, US, vol. 28, No. 11, Nov. 1, 1980, pp. 787-794.
"Speaker Placement" Oct. 10, 2004, Retrieved from the Internet: URL: http://web.archive.org/web/20041010051626/http://www.gcaudio.com/resources/howtos/speakerplacement.html.

* cited by examiner

METHOD AND APPARATUS FOR REPRODUCING AUDIO SIGNAL

CROSS REFERENCES TO RELATED APPLICATIONS

The present invention contains subject matter related to Japanese Patent Application JP 2004-297093 filed in the Japanese Patent Office on Oct. 12, 2004, the entire contents of which are incorporated herein by reference.

BACKGROUND OF THE INVENTION

1. Field of the Invention

The present invention relates to a method and apparatus for reproducing an audio signal.

2. Description of the Related Art

In a two-channel stereo system, for example, as shown in FIG. 14, a virtual sound source VSS is produced on a line between a left-channel loudspeaker SPL and a right-channel loudspeaker SPR, and sound is perceived as being output from the virtual sound source VSS. When a listener is positioned at a vertex of an isosceles triangle whose base is the line between the loudspeakers SPL and SPR, a stereo sound field with the balanced right and left outputs is realized. In particular, the best stereo effects are given to the listener who is at a vertex P0 of an equilateral triangle (see PCT Japanese Translation Patent Publication No. 2002-505058).

SUMMARY OF THE INVENTION

Actually, however, the listener is not always at the best listening point P0. For example, in an environment where a plurality of listeners exist, some listeners may be near either loudspeaker. Such listeners can listen to unnatural sound that is unbalanced sound in which reproduced sound in either channel is emphasized.

Even in an environment where a single listener exists, a listening point at which the best effect is given is limited to the point P0.

A method for reproducing an audio signal according to an embodiment of the present invention includes the steps of supplying a first audio signal to a first loudspeaker array to perform wavefront synthesis, producing a first virtual sound source at an infinite distance using wavefront synthesis, supplying a second audio signal to a second loudspeaker array to perform wavefront synthesis, and producing a second virtual sound source at an infinite distance using wavefront synthesis, wherein a propagation direction of a first sound wave obtained from the first virtual sound source and a propagation direction of a second sound wave obtained from the second virtual sound source cross each other.

According to an embodiment of the present invention, right- and left-channel sound waves are output as parallel plane waves from loudspeakers. Therefore, sound can be reproduced at the same volume level throughout a listening area for each channel of sound waves, and the listener can listen to right- and left-channel sound with balanced volume levels throughout this listening area.

BRIEF DESCRIPTION OF THE DRAWINGS

FIG. 13 is a diagram showing the operation of a reproduction apparatus according to an embodiment of the present invention; and FIG. 14 is a diagram showing a general stereo sound field.

DESCRIPTION OF THE PREFERRED EMBODIMENTS

According to an embodiment of the present invention, a virtual sound source is produced using wavefront synthesis, and the position of the virtual sound source is controlled to propagate left- and right-channel sound waves as parallel plane waves.

[1] Sound Field Reproduction

Figure 1:
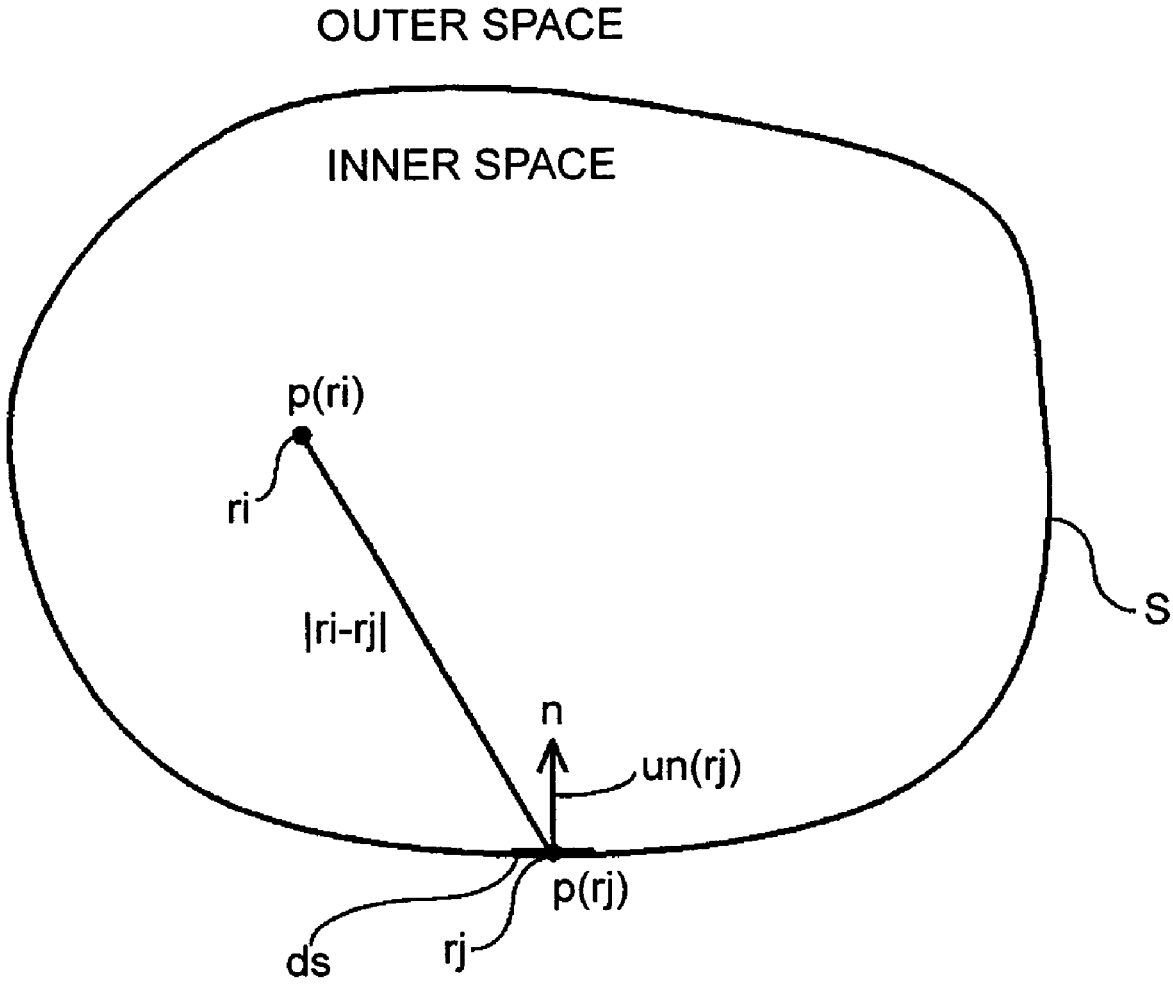
FIG. 1 is a diagram of an acoustic space to show an embodiment of the present invention.

Referring to FIG. 1, a closed surface S surrounds a space having an arbitrary shape, and no sound source is included in the closed surface S. The following symbols are used to denote inner and outer spaces of the closed surface S:

p(ri): sound pressure at an arbitrary point ri in the inner space p(rj): sound pressure at an arbitrary point rj on the closed surface S ds: small area including the point rj n: vector normal to the small area ds at the point rj un(rj): particle velocity at the point rj in the direction of the normal n ω: angular frequency of an audio signal ρ: density of air v: velocity of sound (=340 m/s)

k: ω/v

The sound pressure p(ri) is determined using Kirchhoff's integral formula as follows:

$$p(ri) = \int_s \left( p(rj) \frac{\partial Gij}{\partial n} j\omega\rho un(rj) Gij \right) ds \qquad \text{Eq. (1)}$$

$$\text{where } G_{ij} = \frac{\exp(-jk|ri - rj|)}{4\pi|ri - rj|}$$

Eq. (1) means that appropriate control of the sound pressure p(rj) at the point rj on the closed surface S and the particle velocity un(rj) at the point rj in the direction of the normal vector n allows for reproduction of a sound field in the inner space of the closed surface S.

Figure 2A:
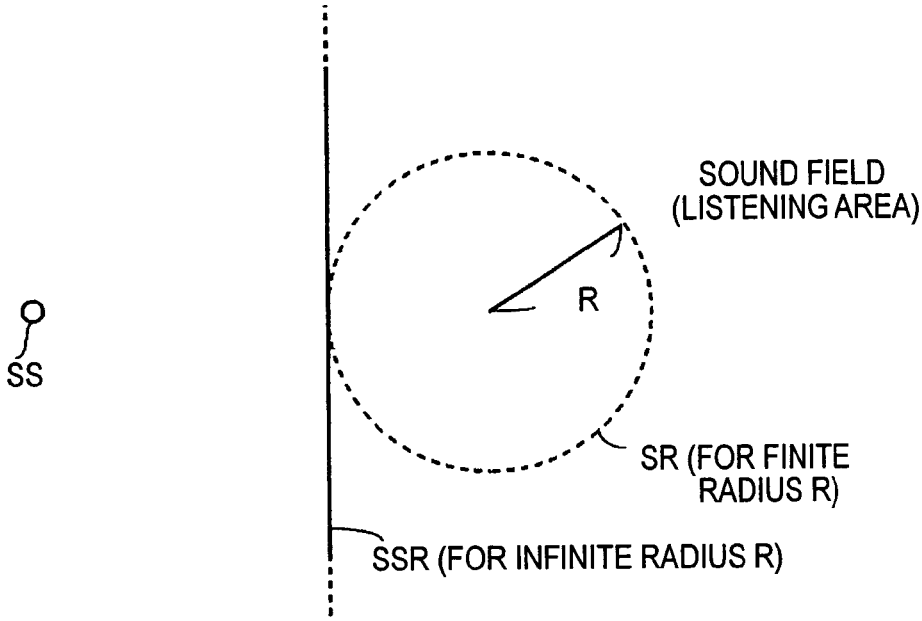
FIGS. 2A and 2B are diagrams of acoustic spaces to show an embodiment of the present invention.

For example, a sound source SS is shown in the left portion of FIG. 2A, and a closed surface SR (indicated by a broken circle) that surrounds a spherical space having a radius R is shown in the right portion of FIG. 2A. As described above, with the control of the sound pressure on the closed surface SR and the particle velocity un(rj), a sound field generated in the inner space of the closed surface SR by the sound source SS can be reproduced without the sound source SS. A virtual sound source VSS is generated at the position of the sound source SS. Accordingly, the sound pressure and particle velocity on the closed surface SR are appropriately controlled, thereby allowing a listener within the closed surface SR to perceive sound as if the virtual sound source VSS were at the position of the sound source SS.

When the radius R of the closed surface SR is infinite, a planar surface SSR rather than the closed surface SR is defined, as indicated by a solid line shown in FIG. 2A. Also, with the control of the sound pressure and particle velocity on the planar surface SSR, a sound field generated in the inner space of the closed surface SR, or generated in the region right to the planar surface SSR, by the sound source SS can be reproduced without the sound source SS. Also in this case, a virtual sound source VSS is generated at the position of the sound source SS.

Therefore, appropriate control of the sound pressure and particle velocity at all points on the planar surface SSR allows the virtual sound source VSS to be placed to the left of the planar surface SSR, and allows a sound field to be placed to the right. The sound field can be a listening area.

Figure 2B:
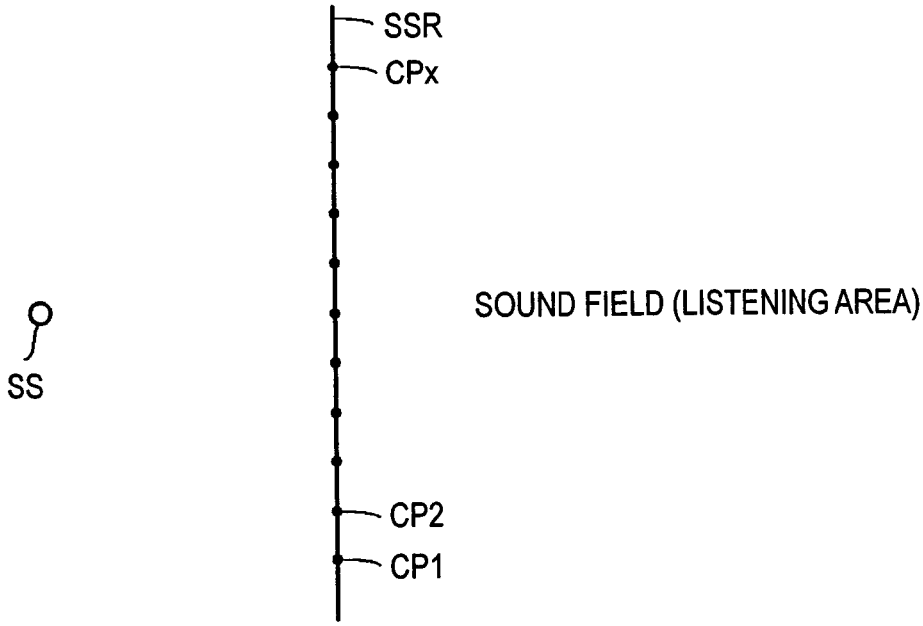

Actually, as shown in FIG. 2B, the planar surface SSR is finite in width, and the sound pressure and particle velocity at finite points CP1 to CPx on the planar surface SSR are controlled. In the following description, the points CP1 to CPx at which the sound pressure and the particle velocity on the planar surface SSR are controlled are referred to as "control points".

Figure 3:
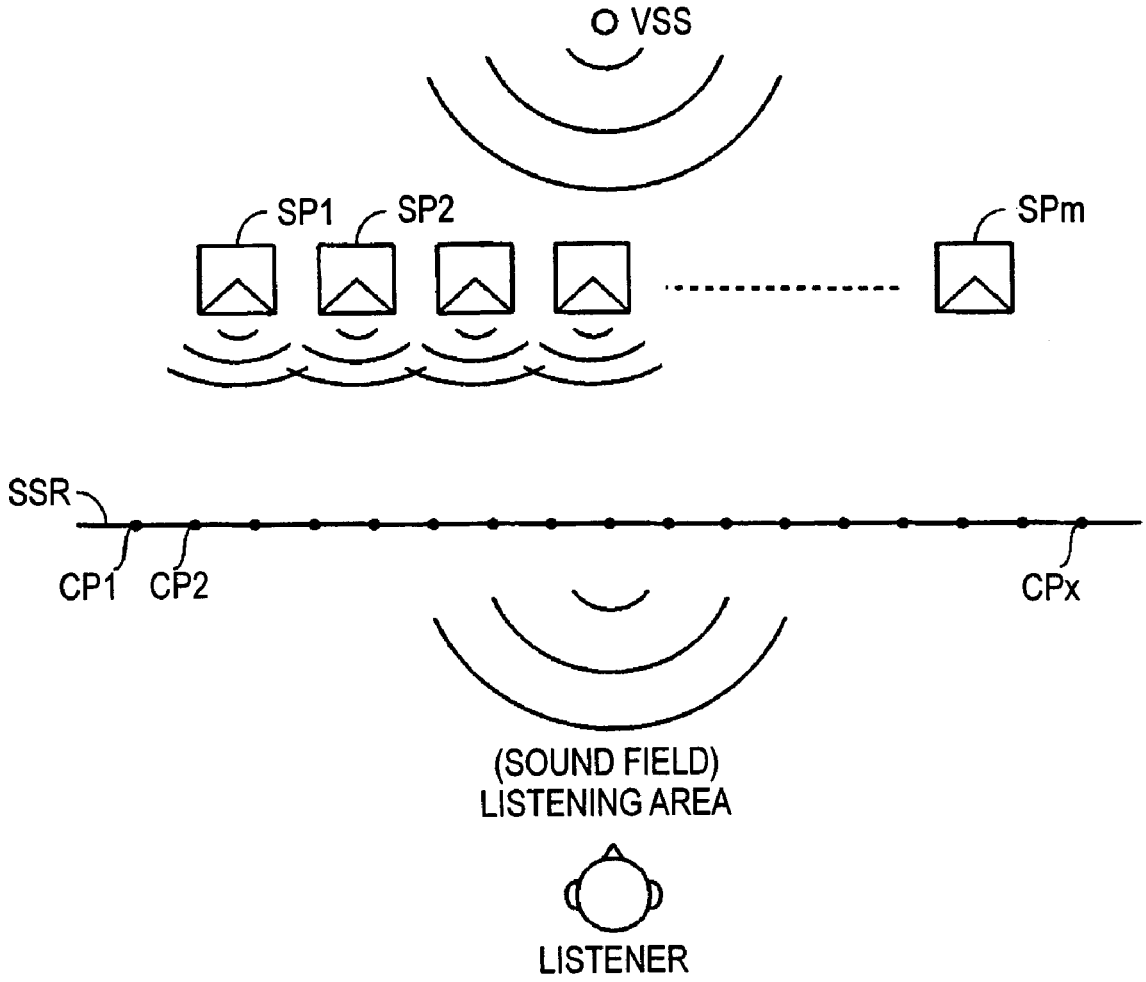
FIG. 3 is a diagram showing an exemplary acoustic space according to an embodiment of the present invention.

[2] Control of Sound Pressure and Particle Velocity at Control Points CP1 to CPx In order to control the sound pressure and the particle velocity at the control points CP1 to CPx, as shown in FIG. 3, the following procedure is performed:

(A) A plurality of m loudspeakers SP1 to SPm are placed near the sound source with respect to the planar surface SSR, for example, in parallel to the planar surface SSR. A loudspeaker array is a collection of the loudspeakers SP1 to SPm.

(B) An audio signal supplied to the loudspeakers SP1 to SPm is controlled to control the sound pressure and particle velocity at the control points CP1 to CPx.

In this way, sound waves output from the loudspeakers SP1 to SPm are reproduced using wavefront synthesis as if the sound waves were output from the virtual sound source VSS to produce a desired sound field. The position at which the sound waves output from the loudspeakers SP1 to SPm are reproduced using wavefront synthesis is on the planar surface SSR. Thus, in the following description, the planar surface SSR is referred to as a "wavefront-synthesis surface."

[3] Simulation of Wavefront Synthesis

Figure 4B:
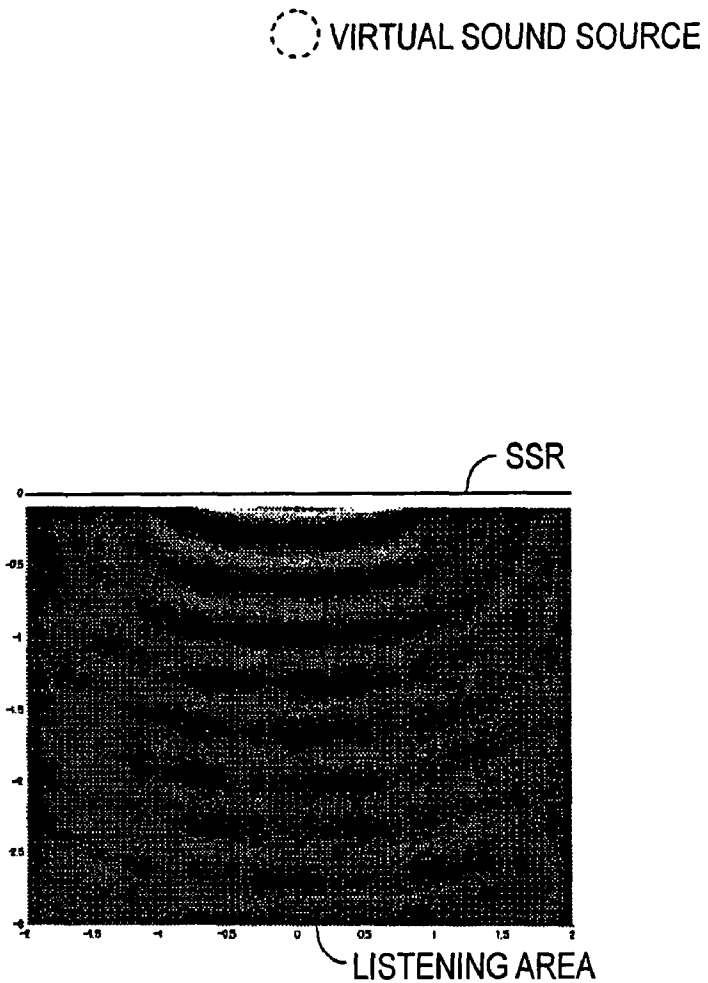
FIGS. 4A and 4B are simulation diagrams of wavefront synthesis according to an embodiment of the present invention.
Figure 4A:
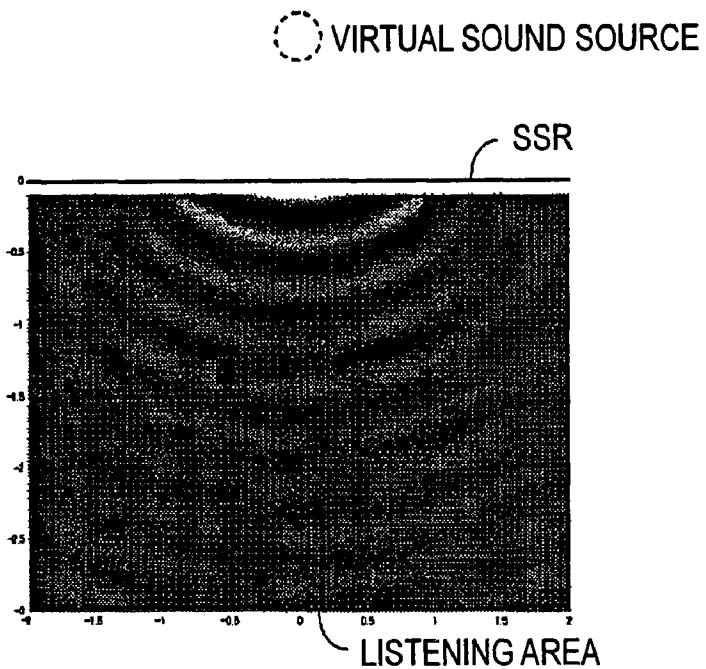

FIGS. 4A and 4B show exemplary computer-based simulations of wavefront synthesis. Although processing of an audio signal supplied to the loudspeakers SP1 to SPm is discussed below, the simulations are performed using the following values:

Number m of loudspeakers: 16

Distance between loudspeakers: 10 cm

Diameter of each loudspeaker: 8 cmϕ

Position of a control point: 10 cm apart from each loudspeaker towards the listener Number of control points: 116 (spaced at 1.3-cm intervals in a line)

Position of the virtual sound source shown in FIG. 4A: 1 m in front of the listening area Position of the virtual sound source shown in FIG. 4B: 3 m in front of the listening area Size of the listening area: 2.9 m (deep)×4 m (wide)

When the distance between the loudspeakers, which is expressed in meters (m), is represented by w, the velocity of sound (=340 m/s) is represented by v, and the upper limit frequency for reproduction, which is expressed in hertz (Hz), is represented by fhi, the following equation is defined:

$$fhi=v/(2w)$$

It is therefore preferable to reduce the distance w between the loudspeakers SP1 to SPm (m=16). Thus, the smaller the diameter of the loudspeakers SP1 to SPm, the better.

When the audio signal supplied to the loudspeakers SP1 to SPm is a digitally processed signal, preferably, the distance between the control points CP1 to CPx is not more than ¼ to ⅕ of the wavelength corresponding to the sampling frequency in order to suppress sampling interference. In these simulations, a sampling frequency of 8 kHz is provided, and the distance between the control points CP1 to CPx is 1.3 cm, as described above.

In FIGS. 4A and 4B, the sound waves output from the loudspeakers SP1 to SPm are reproduced using wavefront synthesis as if they were output from the virtual sound source VSS, and a clear wave pattern is shown in the listening area. That is, wavefront synthesis is appropriately performed to produce a target virtual sound source VSS and a sound field.

In the simulation shown in FIG. 4A, the position of the virtual sound source VSS is 1 m in front of the listening area, and the virtual sound source VSS is relatively close to the wavefront-synthesis surface SSR. The curvature of the wave pattern is therefore small. In the simulation shown in FIG. 4B, on the other hand, the position of the virtual sound source VSS is 3 m in front of the listening area, and the virtual sound source VSS is farther from the wavefront-synthesis surface SSR than that shown in FIG. 4A. The curvature of the wave pattern is therefore larger than that shown in FIG. 4A. Thus, the sound waves become closer to the parallel plane waves as the virtual sound source VSS is farther from the wavefront-synthesis surface SSR.

[4] Parallel-Plane-Wave Sound Field

Figure 5A:
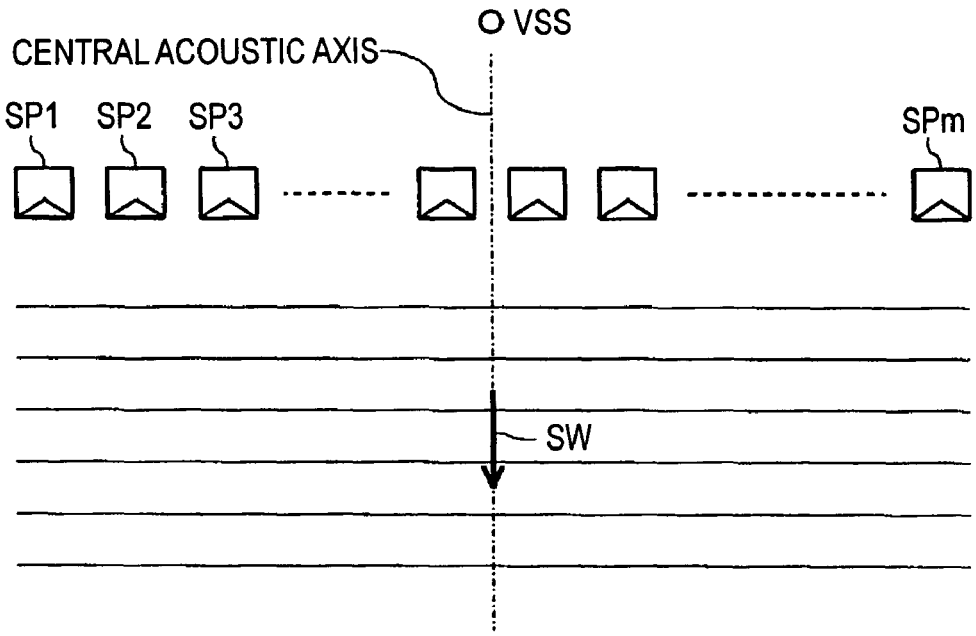
FIGS. 5A and 5B are diagrams showing wavefronts according to an embodiment of the present invention.

As shown in FIG. 5A, a virtual sound source VSS is produced based on the outputs from the loudspeakers SP1 to SPm using wavefront synthesis. The virtual sound source VSS is placed at an infinite distance from the loudspeakers SP1 to SPm (the wavefront-synthesis surface SSR), and is placed on the acoustic axis in the center of the loudspeakers SP1 to SPm. As is apparent from the simulations of wavefront synthesis in the previous section (Section [3]), a sound wave (wave pattern) SW obtained by wavefront synthesis also has an infinite curvature, and the sound wave SW propagates as parallel plane waves along the acoustic axes of the loudspeakers SP1 to SPm.

Figure 5B:
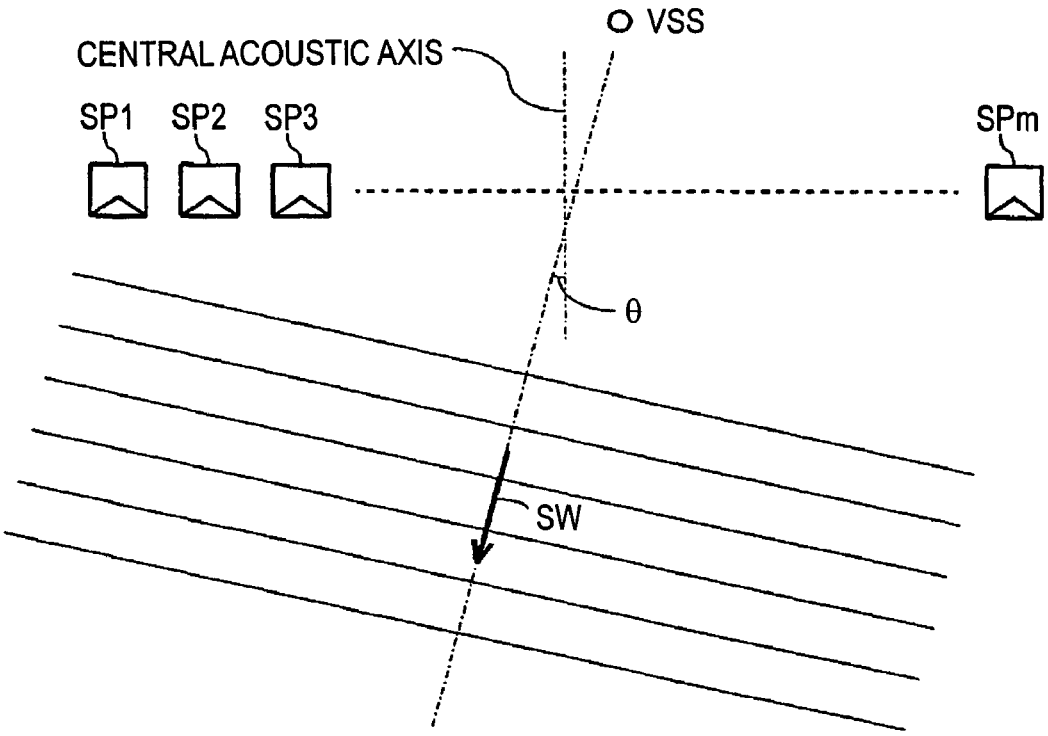

As shown in FIG. 5B, on the other hand, when the virtual sound source VSS is placed at an infinite distance from the loudspeakers SP1 to SPm, if the position of the virtual sound source VSS is offset from the central acoustic axis of the loudspeakers SP1 to SPm, the sound wave SW obtained by wavefront synthesis propagates as parallel plane waves, and the angle θ defined between the propagation direction of the sound wave SW and the acoustic axis of the loudspeakers SP1 to SPm is set to $\theta \neq 0$.

In the following description, the angle θ is referred to as a "yaw angle." In stereo, $\theta=0$ is set when the propagation direction of the sound wave SW is along the central acoustic axis of the loudspeakers SP1 to SPm, $\theta>0$ is set for the counter-clockwise direction in the left channel, and $\theta<0$ is set for the clockwise direction in the right channel.

Since the sound wave SW shown in FIGS. 5A and 5B includes parallel plane waves, the sound wave SW has the same sound pressure throughout a sound field generated by the sound wave SW, and there is no difference in sound pressure level. Therefore, the volume levels are the same throughout the sound field of the sound wave SW.

[5] Wavefront Synthesis Algorithm

Figure 6:
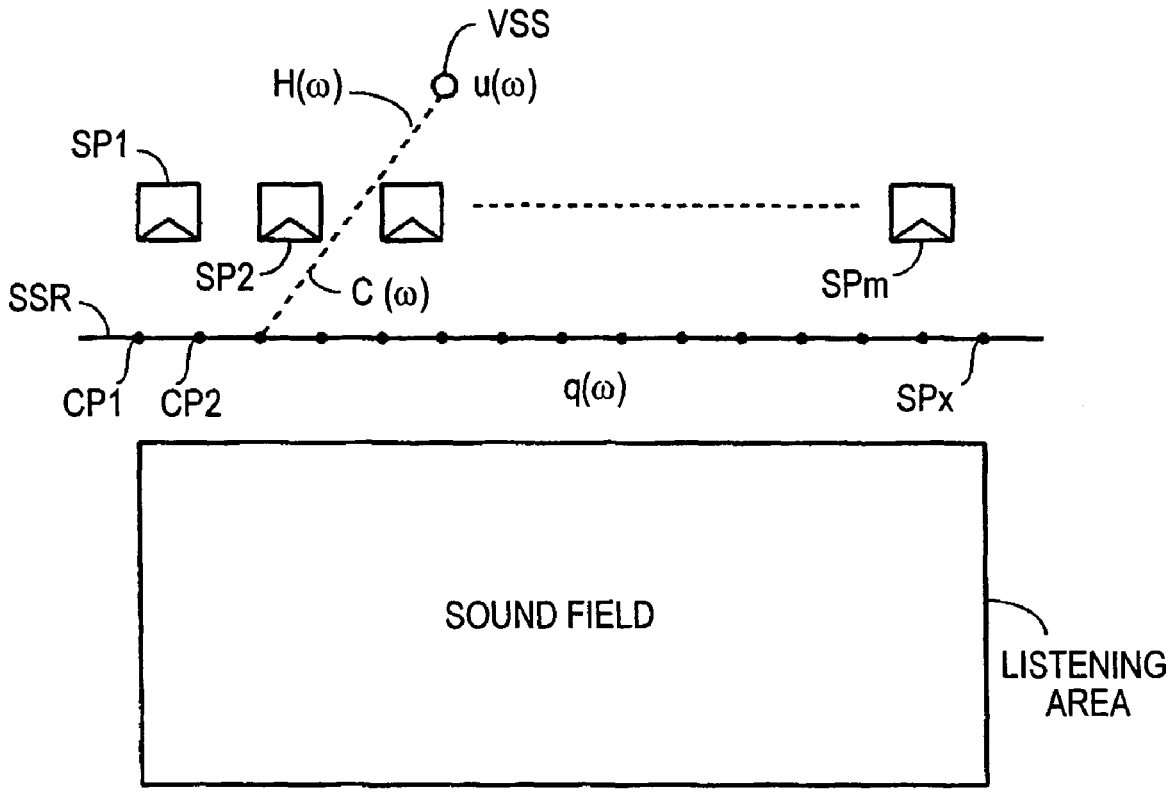
FIG. 6 is a diagram of an acoustic space to show an embodiment of the present invention.

In FIG. 6, the following symbols are used:

u(ω): output signal of the virtual sound source VSS, i.e., original audio signal H(ω): transfer function to be convoluted with the signal u(ω) to realize appropriate wavefront synthesis C(ω): transfer function from the loudspeakers SP1 to SPm to the control points CP1 to CPm q(ω): signal which is actually reproduced at the control points CP1 to CPx using wavefront synthesis The reproduced audio signal q(ω) is determined by convoluting and the transfer functions C(ω) and H(ω) into the original audio signal u(ω), and is given by the following equation:

$$q(\omega)=C(\omega)\cdot H(\omega)\cdot u(\omega)$$

The transfer function C(ω) is defined by determining transfer functions from the loudspeakers SP1 to SPm to the control points CP1 to CPx.

With the control of the transfer function H(ω), appropriate wavefront synthesis is performed based on the reproduced audio signal q(ω), and the parallel plane waves shown in FIGS. 5A and 5B are produced.

[6] Generation Circuit

Figure 7:
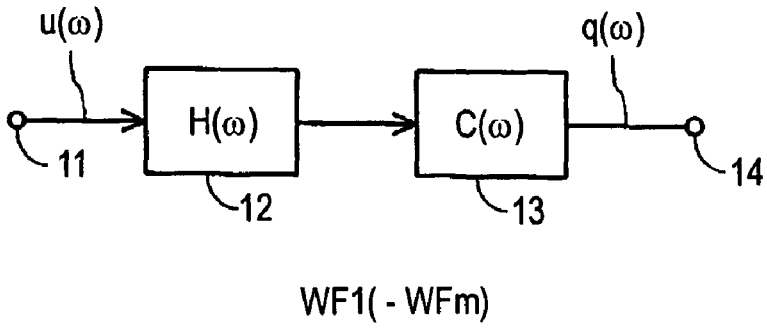
FIG. 7 is a schematic diagram showing a circuit according to an embodiment of the present invention.

A generation circuit for generating the reproduced audio signal q(ω) from the original audio signal u(ω) according to the wavefront synthesis algorithm described in the previous section (Section [5]) may have an example structure shown in FIG. 7. This generation circuit is provided for each of the loudspeakers SP1 to SPm, and generation circuits WF1 to WFm are provided.

In each of the generation circuits WF1 to WFm, the original digital audio signal u(ω) is sequentially supplied to digital filters 12 and 13 via an input terminal 11 to generate the reproduced audio signal q(ω), and the signal q(ω) is supplied to the corresponding loudspeaker in the loudspeakers SP1 to SPm via an output terminal 14. The generation circuits WF1 to WFm may be digital signal processors (DSPs).

Accordingly, the virtual sound source VSS is produced based on the outputs of the loudspeakers SP1 to SPm. The virtual sound source VSS can be placed at an infinite distance from the loudspeakers SP1 to SPm by setting the transfer functions C(ω) and H(ω) of the filters 12 and 13 to predetermined values. As shown in FIG. 5A or 5B, the yaw angle θ can be changed by changing the transfer functions C(ω) and H(ω) of the filters 12 and 13.

[7] First Embodiment

Figure 8:
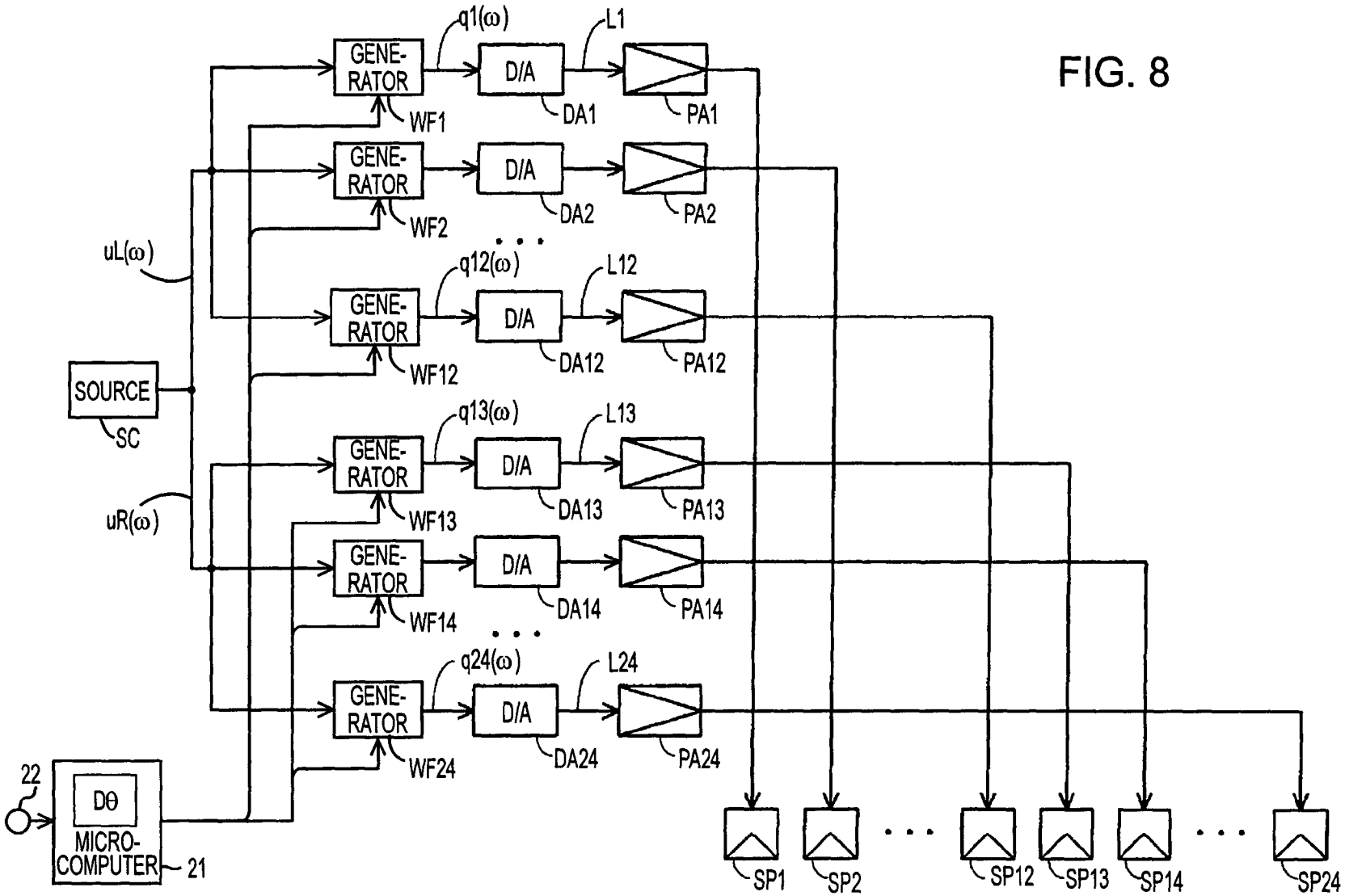
FIG. 8 is a block diagram of a reproduction apparatus according to an embodiment of the present invention.

FIG. 8 shows a reproduction apparatus according to a first embodiment of the present invention. The reproduction apparatus produces the virtual sound source VSS according to the procedure described in the previous sections (Sections [1] to [6]), and sets the position of the virtual sound source VSS at an infinite distance from the wavefront-synthesis surface SSR. In FIG. 8, the number of m loudspeakers SP1 to SPm is 24 (m=24). For example, as shown in FIG. 3, the loudspeakers SP1 to SP24 are horizontally placed in front of the listener to produce a loudspeaker array.

In FIG. 8, a left-channel digital audio signal uL(ω) and a right-channel digital audio signal uR(ω) are obtained from a signal source SC, such as a compact disc (CD) player, a digital versatile disc (DVD) player, or a digital broadcasting tuner. The signal uL(ω) is supplied to generation circuits WF1 to WF12 to generate reproduced audio signals q1(ω) to q12(ω) corresponding to the reproduced audio signal q(ω). The signal uR(ω) is supplied to generation circuits WF13 to WF24 to generate reproduced audio signals q13(ω) to q24(ω) corresponding to the reproduced audio signal q(ω).

The signals q1(ω) to q12(ω) and q13(ω) to q24(ω) are supplied to digital-to-analog (D/A) converter circuits DA1 to DA12 and DA13 to DA24, and are converted into analog audio signals L1 to L12 and R13 to R24. The signals L1 to L12 and R13 to R24 are supplied to loudspeakers SP1 to SP12 and SP13 to SP24 via power amplifiers PA1 to PA12 and PA13 to PA24.

The reproduction apparatus further includes a microcomputer 21 serving as a position setting circuit for setting the position of the virtual sound source VSS at an infinite distance. The microcomputer 21 has data Dθ for setting the yaw angle θ. The yaw angle θ can be changed in steps of 5° up to, for example, 45° from 0°. The microcomputer 21 therefore includes 24×10 data sets Dθ which correspond to the number of signals q1(ω) to q24(ω), i.e., 24, and the number of yaw angles θ that can be set, i.e., 10, and one of these data sets Dθ is selected by operating an operation switch 22.

The selected data set Dθ is supplied to the digital filters 12 and 13 in each of the generation circuits WF1 to WF24, and the transfer functions H(ω) and C(ω) of the digital filters 12 and 13 are controlled.

Figure 9A:
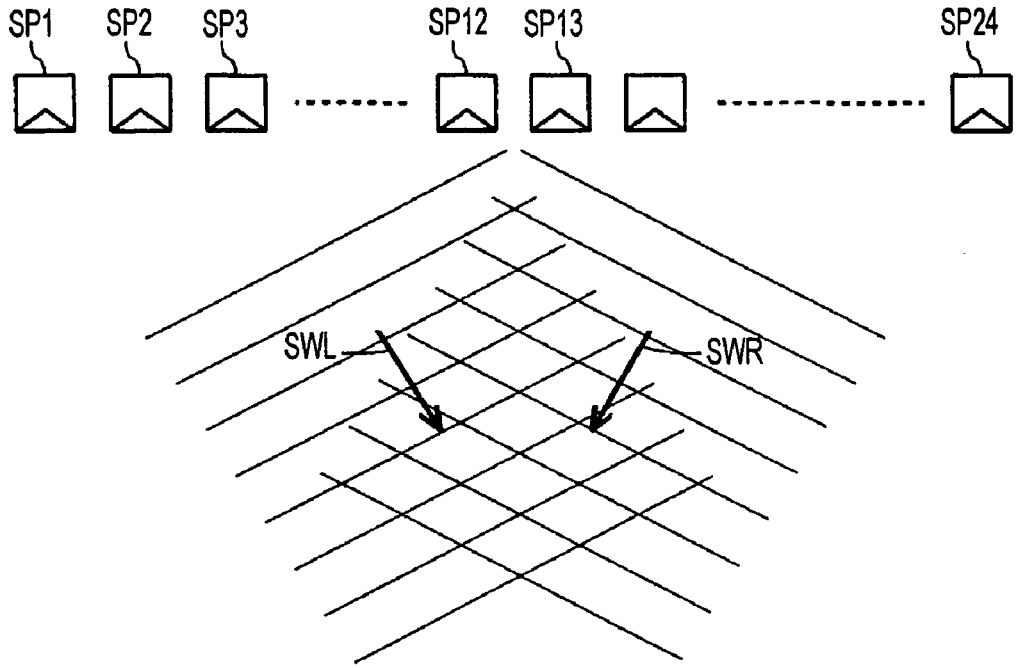
FIGS. 9A and 9B are diagrams showing the operation of the reproduction apparatus according to the embodiment of the present invention.
Figure 9B:
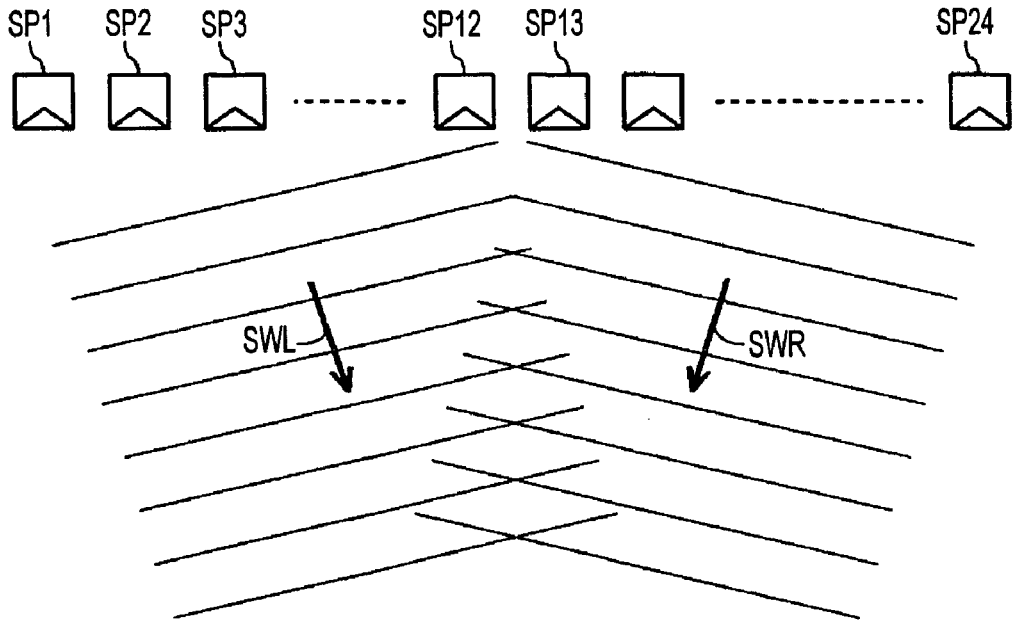

With this structure, the left-channel digital audio signal uL(ω) output from the signal source SC is converted by the generation circuits WF1 to WF24 into the signals q1(ω) to q24(ω), and the audio signals L1 to L12 into which the signals q1(ω) to q24(ω) are digital-to-analog converted are supplied to the loudspeakers SP1 to SP24. Therefore, as shown in FIGS. 9A and 9B, a left-channel sound wave SWL is output as parallel plane waves from the loudspeakers SP1 to SP12. Likewise, based on the right-channel digital audio signal uR(ω), a right-channel sound wave SWR is output as parallel plane waves from the loudspeakers SP13 to SP24.

The listener can therefore listen to the audio signals uL(ω) and uR(ω) output from the signal source SC in stereo. The volume levels in the left channel are the same throughout the listening area for the left-channel sound wave SWL, and the volume levels in the right channel are the same throughout the listening area for the right-channel sound wave SWR.

Therefore, in a listening area for both the sound waves SWL and SWR, i.e., in FIGS. 9A and 9B, an area which the sound waves SWL and SWR overlap each other, the volume levels in the left channel and the volume levels in the right channel are the same throughout this listening area. Therefore, the listener can listen to right- and left-channel sound with balanced volume levels throughout this listening area.

For example, even in an environment where a plurality of listeners exist, all listeners can listen to music, etc., with the optimum balanced volume levels in the right and left channels. Even in an environment where a single listener exists, the listening point is not limited to a specific point, and the listener can listen to sound at any place. The sound can also be spatialized.

When the operation switch 22 is operated to change the data Dθ, the characteristics of the filters 12 and 13 in each of the generation circuits WF1 to WF24 are controlled according to the data Dθ. For example, as shown in FIG. 9A or 9B, the yaw angle θ is changed in steps of 5° up to 45° from 0° depending on the data Dθ. FIGS. 9A and 9B show that the yaw angle θ is large and small, respectively.

The yaw angle θ is changed to change the listening areas for the sound waves SWL and SWR depending on the listener or listeners, thereby providing a desired sound field.

[8] Second Embodiment

Figure 10:
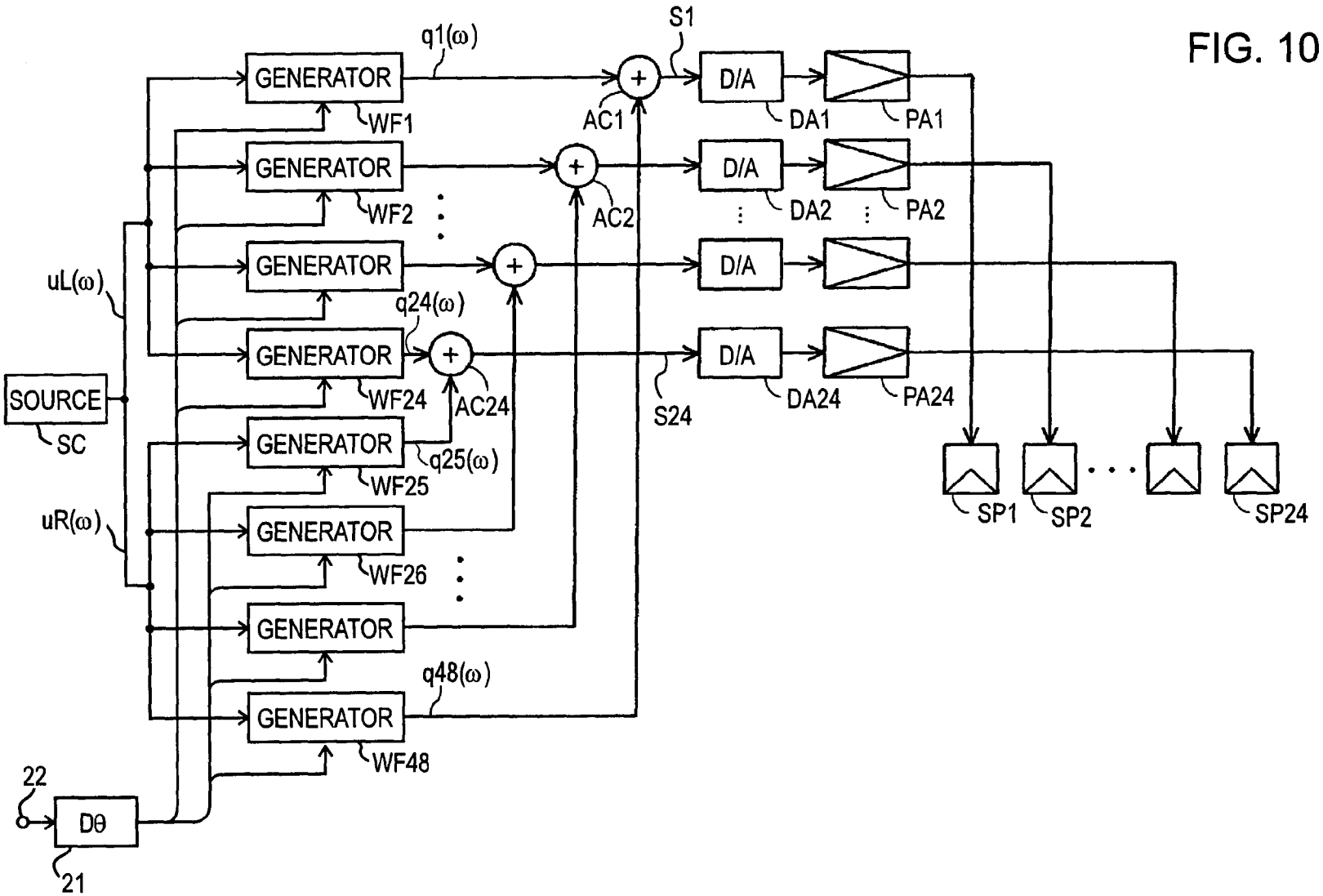
FIG. 10 is a block diagram of a reproduction apparatus according to an embodiment of the present invention.
Figure 11A:
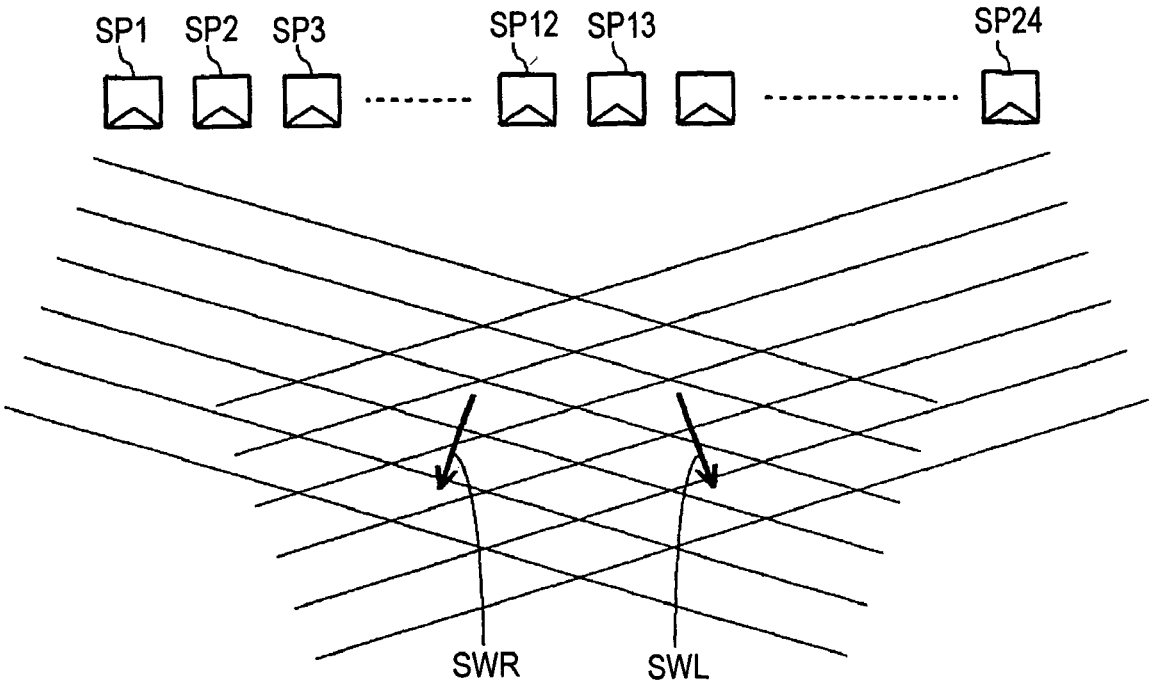
FIGS. 11A and 11B are diagrams showing the operation of the reproduction apparatus according to the embodiment of the present invention.
Figure 11B:
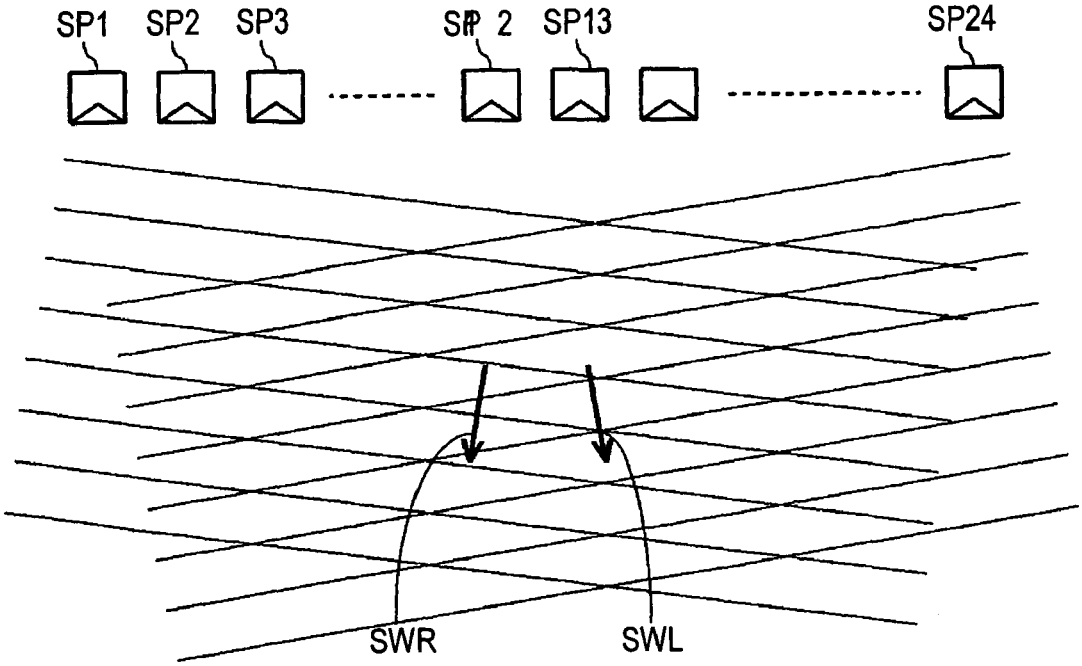

FIG. 10 shows a reproduction apparatus according to a second embodiment of the present invention. In the second embodiment, as shown in FIGS. 11A and 11B, the area in which the sound waves SWL and SWR output from the virtual sound source VSS propagate as parallel plane waves is wider than that in the first embodiment described in the previous section (Section [7]).

As in the first embodiment described in the previous section (Section [7]), the number of m loudspeakers SP1 to SPm is 24 (m=24), and, for example, the loudspeakers SP1 to SP24 are horizontally placed in front of the listener in the manner shown in FIG. 3 to produce a loudspeaker array.

Left- and right-channel digital audio signals uL(ω) and uR(ω) are obtained from a signal source SC. The signal uL(ω) is supplied to generation circuits WF1 to WF24 to generate reproduced audio signals q1(ω) to q24(ω) corresponding to the reproduced audio signal q(ω). The signals q1(ω) to q24(ω) are supplied to adding circuits AC1 to AC24.

The signal uR(ω) is supplied to generation circuits WF25 to WF48 to generate reproduced audio signals q25(ω) to q48(ω) corresponding to the reproduced audio signal q(ω), and the signals q25(ω) to q48(ω) are supplied to the adding circuits AC24 to AC1. The adding circuits AC1 to AC24 output added signals S1 to S24 of the signals q1(ω) to q24(ω) and q25(ω) to q48(ω). The added signals S1 to S24 are given by the following equations:

$$S1 = q1(\omega) + q25(\omega)$$
$$S2 = q2(\omega) + q26(\omega)$$
$$\ldots$$
$$S24 = q24(\omega) + q48(\omega)$$

The added signals S1 to S24 are supplied to D/A converter circuits DA1 to DA24, and are converted into analog audio signals. The analog signals are supplied to the loudspeakers SP1 to SP24 via power amplifiers PA1 to PA24.

The reproduction apparatus further includes a microcomputer 21 serving as a position setting circuit for setting the position of the virtual sound source VSS at an infinite distance. The microcomputer 21 has data Dθ for setting the yaw angle θ. If the yaw angle θ can be changed in steps of 5° up to, for example, 45° from 0°, the microcomputer 21 includes 48×10 data sets Dθ which correspond to the number of signals q1(ω) to q48(ω), i.e., 48, and the number of yaw angles θ that can be set, i.e., 10, and one of these data sets Dθ is selected by operating an operation switch 22. The selected data set Dθ is supplied to the digital filters 12 and 13 in each of the generation circuits WF1 to WF24, and the transfer functions H(ω) and C(ω) of the digital filters 12 and 13 are controlled.

With this structure, since the added signals S1 to S24 are added signals of the reproduced audio signals q1(ω) to q24(ω) in the left channel and the reproduced audio signals q48(ω) to q25(ω) in the right channel, as shown in FIG. 11A or 11B, a left-channel sound wave SWL and a right-channel sound wave SWR are linear added and output from the loudspeakers SP1 to SP24.

When the operation switch 22 is operated to select the data Dθ, the yaw angles θ is changed in the manner shown in FIG. 11A or 11B. FIGS. 11A and 11B show that the yaw angles θ is large and small, respectively.

Therefore, the reproduction apparatus according to the second embodiment can also output the left- and right-channel sound waves SWL and SWR as parallel plane waves, thereby allowing the listener to listen to the audio signals uL(ω) and uR(ω) output from the signal source SC in stereo. The listener can also listen to right- and left-channel sound with balanced levels throughout an area in which the sound waves SWL and SWR overlap each other in FIGS. 11A and 11B.

As can be seen from FIGS. 11A and 11B, the area in which the sound waves SWL and SWR output from the virtual sound source VSS propagate as parallel plane waves is wider than that shown in FIGS. 9A and 9B, thereby allowing the listener to listen to right- and left-channel sound with balanced levels in a wider area. Moreover, monaural reproduction is achieved for θ=0, and the stereo feeling to the sound can therefore be adjusted depending on the yaw angle θ.

[9] Third Embodiment

FIG. 12 shows exemplary application of parallel-plane-wave stereo reproduction to three-channel stereo reproduction in the right, left, and center channels. Such three-channel stereo reproduction can be implemented by combining the surround right and surround left (or rear right and rear left) channels into the front right and front left channels in five-channel stereo reproduction.

In the three-channel stereo reproduction, analog signals of the reproduced audio signals q1(ω) to q8(ω) in the left channel are supplied to eight left-channel loudspeakers SP1 to SP8 in the loudspeakers SP1 to SP24, analog signals of the reproduced audio signals q9(ω) to q16(ω) in the center channel are supplied to eight center-channel loudspeakers SP9 to SP16, and analog signals of the reproduced audio signals q17(ω) to q24(ω) in the right channel are supplied to eight right-channel loudspeakers SP17 to SP24. The reproduced audio signals q1(ω) to q8(ω), q9(ω) to q16(ω), and q17(ω) to q24(ω) are generated in the manner described above.

Figure 12A:
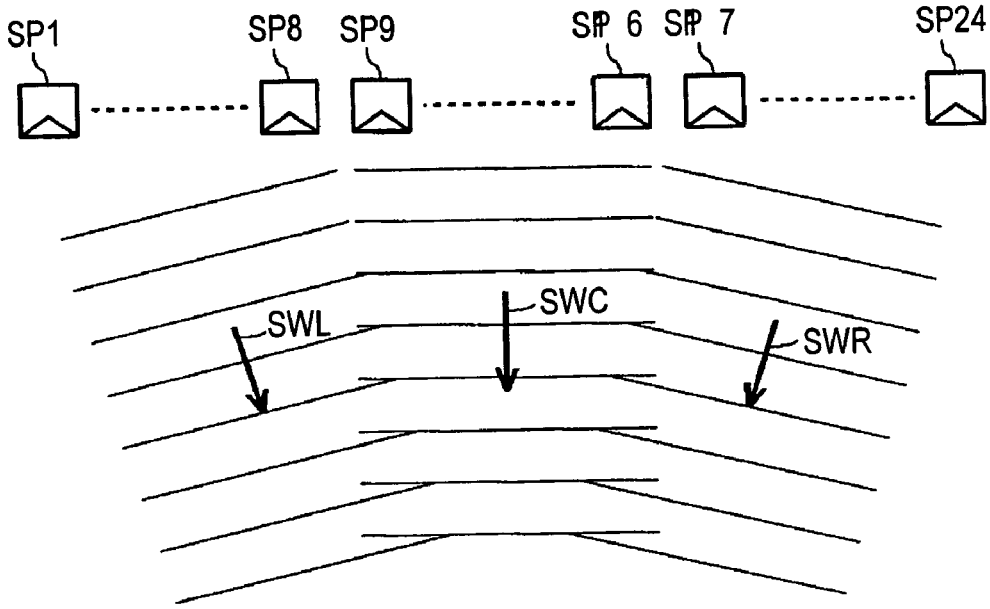
FIGS. 12A and 12B are diagrams showing the operation of a reproduction according to an embodiment of the present invention.
Figure 12B:
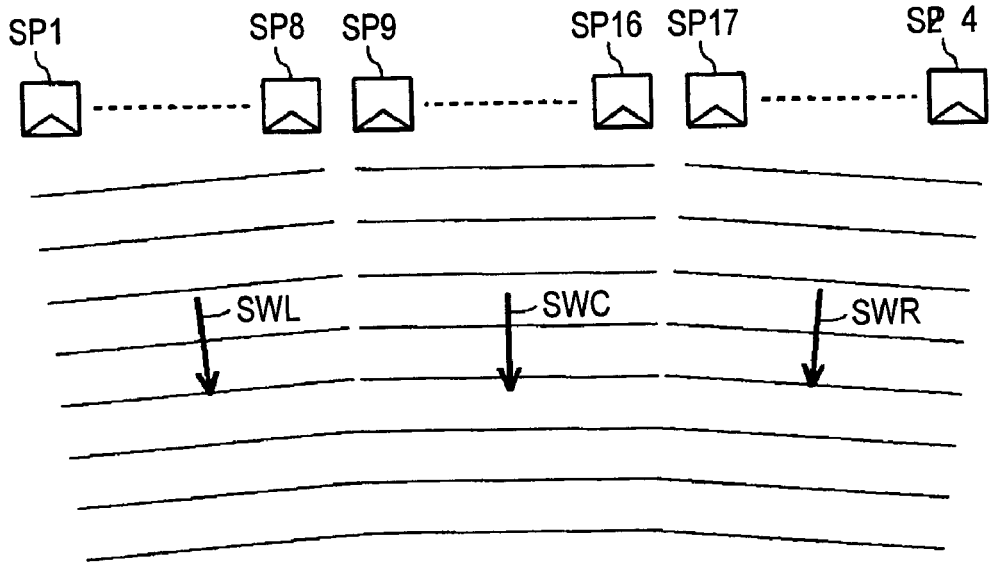
Figure 1:
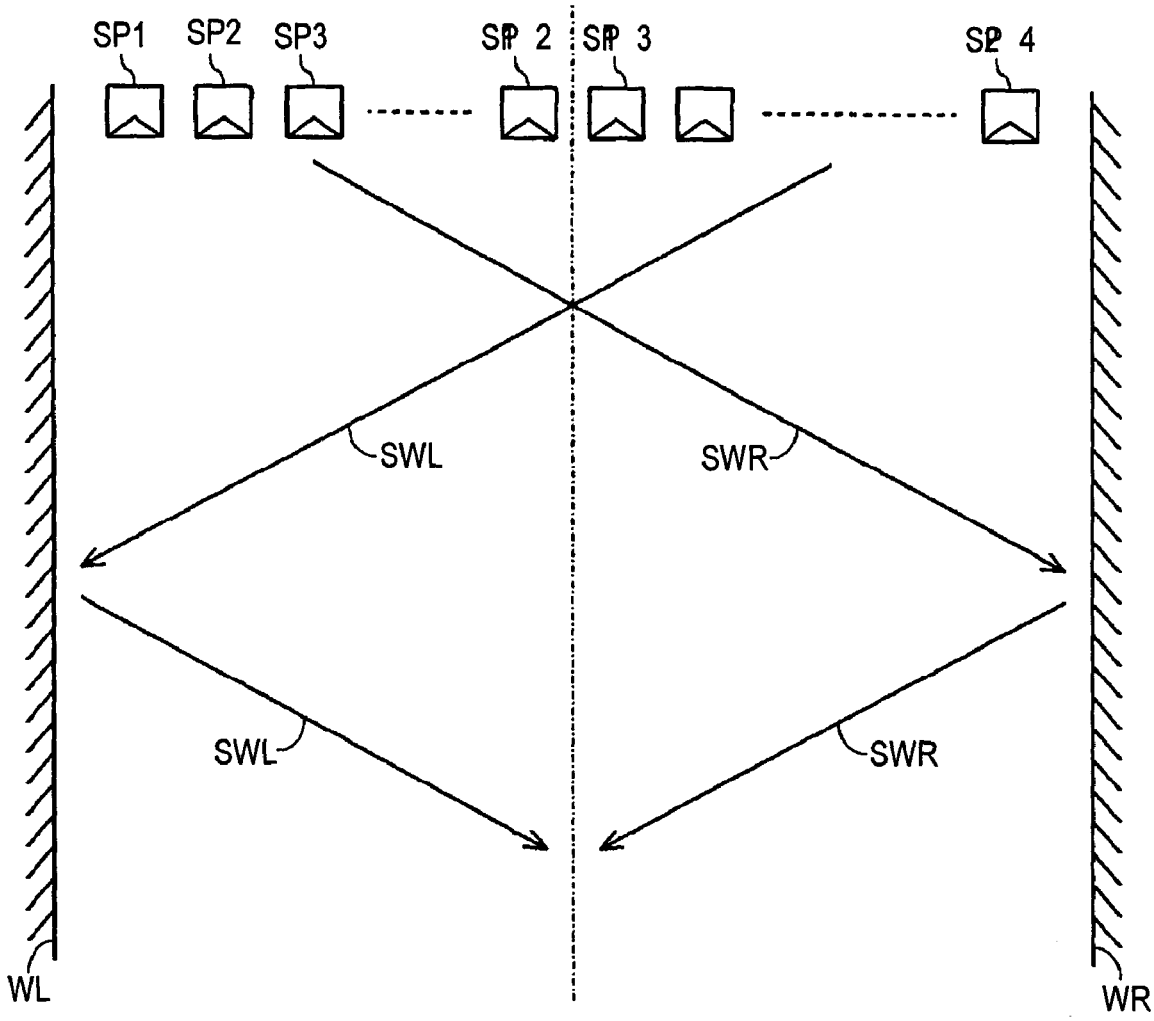
Figure 1:
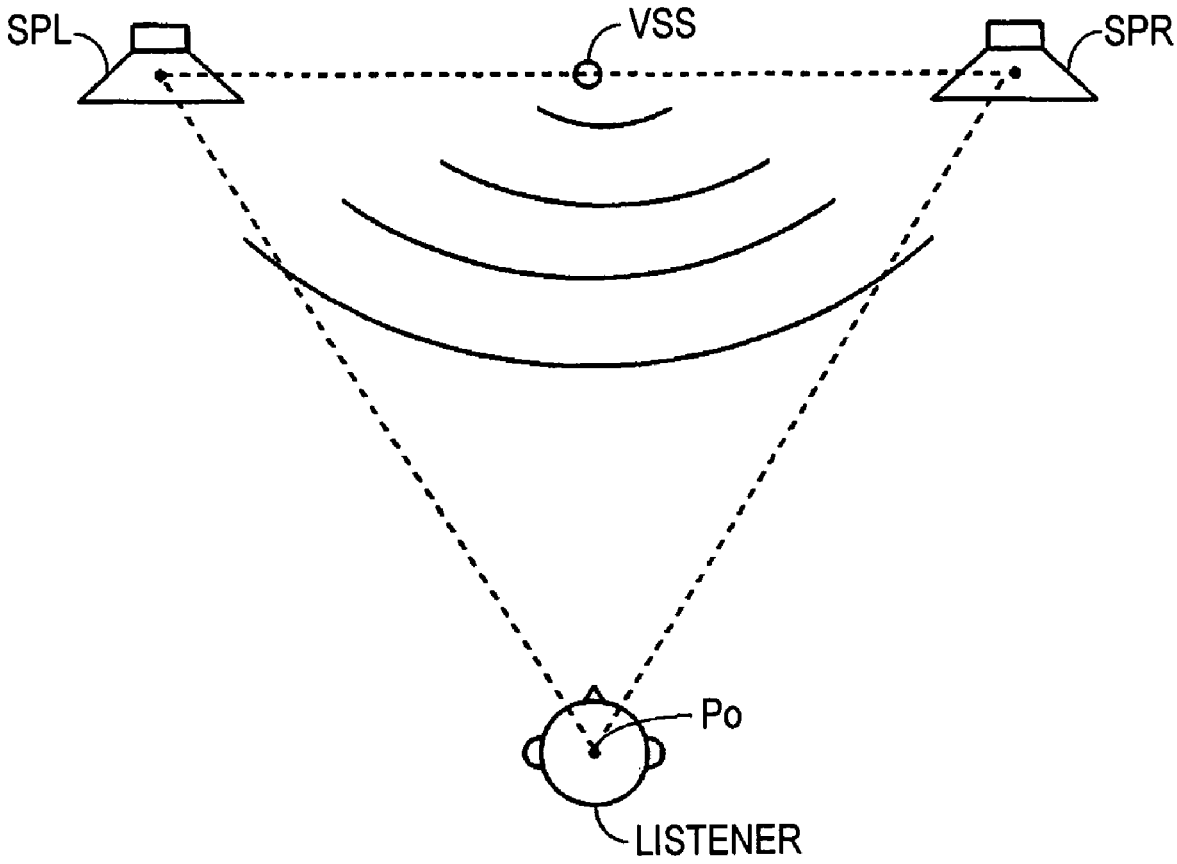

As shown in FIGS. 12A and 12B, therefore, left- and right-channel sound waves SWL and SWR are obtained as parallel plane waves, and a center-channel sound wave SWC is obtained as parallel plane waves. The yaw angle θ of the sound waves SWL and SWR can be changed in the manner shown in, for example, as shown in FIG. 12A or 12B. FIG. 12A or 12B show that the yaw angles θ is large and small, respectively.

[10] Fourth Embodiment

FIG. 13 shows that parallel plane waves output from loudspeakers SP1 to SP24 are reflected on wall surfaces to direct the reflected waves to a listener. Specifically, analog signals of the reproduced audio signals q13(ω) to q24(ω) in the right channel are supplied to left-channel loudspeakers SP1 to SP12 in the loudspeakers SP1 to SP24, and a right-channel sound wave SWR is output as parallel plane waves. The sound wave SWR is reflected on a right wall surface WR.

Analog signals of the reproduced audio signals q1(ω) to q12(ω) in the left channel are supplied to right-channel loudspeakers SP13 to SP24 in the loudspeakers SP1 to SP24, and a left-channel sound wave SWL is output as parallel plane waves. The sound wave SWL is reflected on a left wall surface WL. A sound field is produced by the sound waves SWL and SWR reflected on the wall surfaces WL and WR.

[11] Other Embodiments

While the plurality of m loudspeakers SP1 to SPm have been horizontally placed in a line to produce a loudspeaker array, a loudspeaker array may be a collection of loudspeakers placed in a vertical plane into a matrix having a plurality of rows by a plurality of columns. While the loudspeakers SP1 to SPm and the wavefront-synthesis surface SSR have been parallel to each other, they may not necessarily be parallel to each other. The loudspeakers SP1 to SPm may not be placed in a line or in a plane.

Due to the auditory characteristics that the auditory sensitivity or identification performance is high in the horizontal direction and is low in the vertical direction, the loudspeakers SP1 to SPm may be placed in a cross-like or inverted T-shaped configuration. When the loudspeakers SP1 to SPm are integrated with an audio and visual (AV) system, the loudspeakers SP1 to SPm may be placed on the left, right, top and bottom of a display in a frame-like configuration, or may be placed on the bottom or top, left, and right of the display in a U-shaped or inverted U-shaped configuration. An embodiment of the present invention can also be applied to a rear loudspeaker or a side loudspeaker, or to a loudspeaker system adapted to output sound waves in the vertical direction. An embodiment of the present invention can be combined with a general two-channel stereo or 5.1-channel audio system.

It should be understood by those skilled in the art that various modifications, combinations, sub-combinations and alterations may occur depending on design requirements and other factors insofar as they are within the scope of the appended claims or the equivalents thereof.

What is claimed is:

1. A method for reproducing an audio signal to generate an area of approximately constant sound volume, comprising the steps of:

supplying to a first loudspeaker array a first audio signal corresponding to a right channel, to perform wavefront synthesis, the first loudspeaker array comprising a first plurality of loudspeakers arranged substantially in a plane;

producing a first virtual sound source corresponding to the first audio signal at an infinite distance from the first loudspeaker array using wavefront synthesis;

producing a first planar sound wave from the first loudspeaker array corresponding to the first audio signal;

supplying to a second loudspeaker array a second audio signal corresponding to a left channel, to perform wavefront synthesis, the second loudspeaker array comprising a second plurality of loudspeakers arranged substantially co-planar with the first plurality of loudspeakers of the first loudspeaker array and to the right of the first plurality of loudspeakers from the perspective of an intended listener;

producing a second virtual sound source corresponding to the second audio signal at an infinite distance from the second loudspeaker array using wavefront synthesis; and producing a second planar sound wave from the second loudspeaker array corresponding to the second audio signal, wherein a propagation direction of the first planar sound wave obtained from the first virtual sound source and a propagation direction of the second planar sound wave obtained from the second virtual sound source cross each other.

2. The method according to claim 1, wherein an angle defined by the propagation direction of the first planar sound wave and the propagation direction of the second planar sound wave crossing each other is variable.

3. An apparatus for reproducing an audio signal to generate an area of approximately constant sound volume, the apparatus comprising:

a first loudspeaker array comprising a first plurality of loudspeakers arranged substantially in a plane;

a second loudspeaker array comprising a second plurality of loudspeakers arranged substantially co-planar with the first plurality of loudspeakers of the first loudspeaker array and to the right of the first plurality of loudspeakers from the perspective of an intended listener;

a first processing circuit adapted to process a first audio signal corresponding to a right channel to produce, from the first loudspeaker array, a first planar sound wave corresponding to the first audio signal and having a first propagation direction using wavefront synthesis;

a second processing circuit adapted to process a second audio signal corresponding to a left channel to produce, from the second loudspeaker array, a second planar sound wave corresponding to the second audio signal and having a second propagation direction using wavefront synthesis;

a first setting circuit coupled to the first processing circuit and adapted to set a first virtual position of a first virtual sound source corresponding to the first loudspeaker array; and a second setting circuit coupled to the second processing circuit and adapted to set a second virtual position of a second virtual sound source corresponding to the second loudspeaker array.

wherein the first propagation direction and second propagation direction cross each other.

4. The apparatus according to claim 3, wherein the first setting circuit and the second setting circuit change an angle defined by the first propagation direction and the second propagation direction crossing each other.

5. The method of claim 1, further comprising, using a respective signal generator for each loudspeaker of the first loudspeaker array, applying a transfer function to the first audio signal.

6. The method of claim 5, wherein the respective signal generator for each loudspeaker of the first loudspeaker array is a digital signal processor.

7. The method of claim 5, wherein applying a transfer function to the first audio signal comprises passing the first audio signal through two digital filters.

8. The apparatus of claim 3, wherein the first processing circuit comprises at least two signal generation circuits configured to provide signals to the first loudspeaker array, and wherein a first signal generation circuit of the at least two signal generation circuits is configured to provide a first processed signal to a first loudspeaker of the first loudspeaker array, and wherein a second signal generation circuit of the at least two signal generation circuits is configured to provide a second processed signal to a second loudspeaker of the first loudspeaker array.

9. The apparatus of claim 8, wherein each of the first and second signal generation circuits comprises a digital filter.

10. The apparatus of claim 9, wherein the first signal generation circuit comprises two digital filters.

11. The apparatus of claim 3, wherein the first setting circuit is configured to alter a transfer function of a digital filter of the first processing circuit.

12. The apparatus of claim 3, wherein the first setting circuit and the second circuit are the same.

* * * * *